US006748659B1

(12) United States Patent
Street

(10) Patent No.: US 6,748,659 B1
(45) Date of Patent: Jun. 15, 2004

(54) SAFETY KNIFE CONSTRUCTION

(76) Inventor: Raymond L. Street, 220 W. Smith Ave., Darlington, SC (US) 29532

( * ) Notice: Subject to any disclaimer, the term of this patent is extended or adjusted under 35 U.S.C. 154(b) by 7 days.

(21) Appl. No.: 10/300,858

(22) Filed: Nov. 20, 2002

(51) Int. Cl.[7] ..... B26B 29/00; B26B 3/08; B26B 29/06

(52) U.S. Cl. ..... 30/2; 30/162; 30/290; 30/294

(58) Field of Search ..... 30/2, 123, 143, 30/289, 290, 291, 293, 294, 162

(56) References Cited

U.S. PATENT DOCUMENTS 4,086,698 A 5/1978 Sparks ..... 30/2
4,091,537 A 5/1978 Stevenson, Jr. ..... 30/286
4,489,489 A * 12/1984 Sarto ..... 30/2
4,987,682 A 1/1991 Minnick ..... 30/295
5,144,749 A 9/1992 Chen ..... 30/319
6,484,404 B1 * 11/2002 Kao ..... 30/162
6,591,501 B1 * 7/2003 Phillips ..... 30/2

* cited by examiner

*Primary Examiner*—Charles Goodman
(74) *Attorney, Agent, or Firm*—Sturm & Fix LLP

(57) ABSTRACT

A safety knife construction (10) including: a mounting member (20) affixed to the bottom of a conventional utility knife (100) having a cutting blade (101) retractably disposed in a knife sheath (104) under the influence of a push button (102) and, a wheeled arm member (30) pivotally connected to the mounting member (20) and normally disposed in a closed covering relationship with the cutting blade (101) under the influence of a spring element (40).

4 Claims, 2 Drawing Sheets

SAFETY KNIFE CONSTRUCTION

CROSS REFERENCE TO RELATED APPLICATIONS

This invention was the subject matter of Document Disclosure Program Registration No. 511,426, filed in the U.S. Patent and Trademark Office on May 13, 2002.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of retractable blade protectors for cutting implements in general and in particular to a retractable wheelded guard for a box cutter or the like.

2. Description of Related Art

As can be seen by reference to the following U.S. Pat. Nos. 4,086,698; 4,987,682; 5,144,749, and 4,091,537, the prior art is replete with myriad and diverse safety gurad arrangements for utility knives, box cutters, or the like.

While all of the aforementioned prior art constructions are more than adequate for the basic purpose and function for which they have been specifically designed, they are uniformly deficient with respect to their failure to provide a simple, efficient, and practical retractable wheeled blade guard for utility knives.

As most users of utility knives are all too well aware particularly while cutting open a box or carton it is extremely difficult sometimes to control the depth of penetration of the box while making a sweeping cutting motion, and this difficulty sometimes results in the unintended damage to the contents of the box or carton.

As a consequence of the foregoing situation, there has existed a longstanding need among users of utility knives for a new and improved retractable blade guard that bboth limits the depth of penetration of the cutting blade, facilitates the movement of hte vutting blade along the top of a box or carton and immediately resumes its blade guard role at the end of the effective cutting motion, and the provision of such a construction is a stated objective of the present invention.

BRIEF SUMMARY OF THE INVENTION

Briefly stated, the safety knife construction that forms the basis of the present invnetion comprises a conventional retractable blade utility knife to which is added a ounting member and a wheeled arm member that is pivotally connected to the mounting member and urged into a normally closed blade covering position by a spsring biasing element.

As will be explained in greater detail further on in the specification, the normally closed blade covering position of the wheeled arm member can be overcome by the user prior to initiating the cutting stroke by orienting the utility knife in a downward position such that the wheeled arm member can be foreced rearwardly agaisnt the opposing force of the spring biasing element.

Then once the wheel on the outboard end of the mounting member and the top of a box or carton the maximum depth of hte utility knife cutting blade will be established.

Also at the effective end of hte cutting stroke the spring biasing elemtn will immediately restore the wheeled arm member into its normally closed blade covering position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
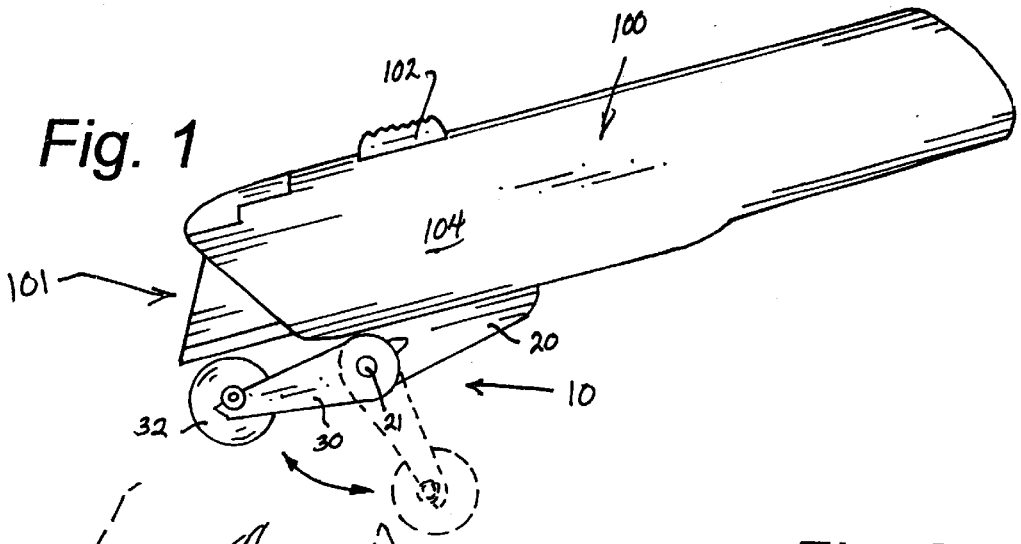
FIG. 1 is a perspective view of the safety knife construction that forms the basis of hte present invention with the cutting blade extended.
Figure 2A:
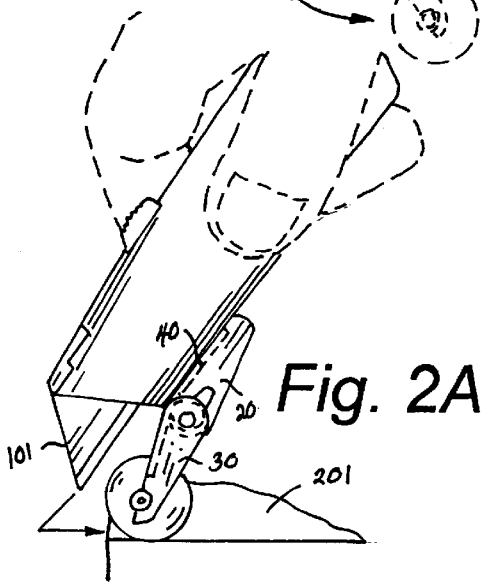
FIGS. 2A through 2D show the relative position of the wheeled arm member relative tot he cutting blade before, during and after the cutting stroke.
Figure 2B:
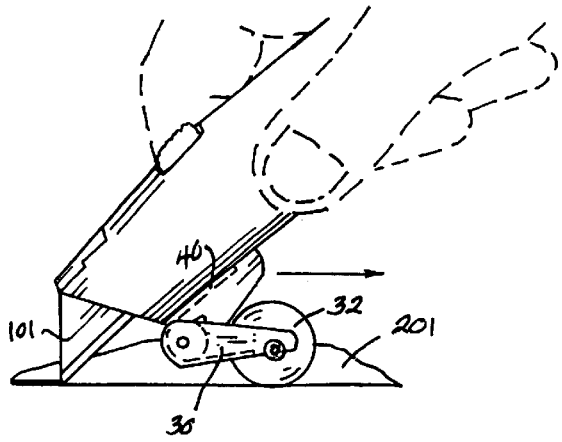
Figure 2C:
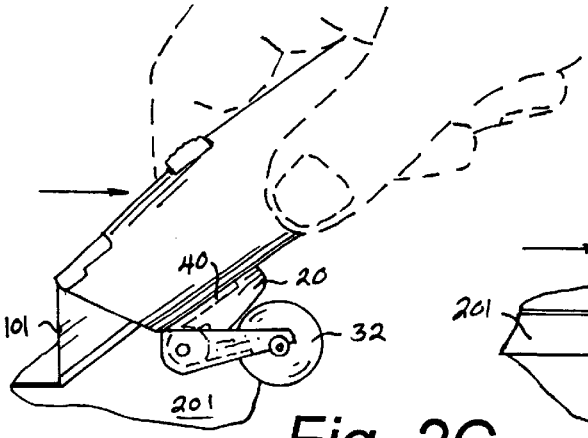
Figure 2D:
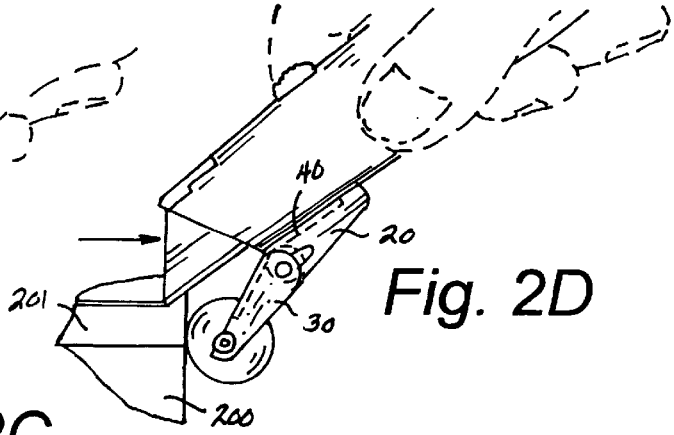

As can be seen by reference to the drawings, and in particularly to FIG. 1, the safety knife construction that forms the basis of the present invention is designated generally by the reference number 10. In essence, the construction 10 involves a modification to a conventional utility knife 100 having a cutting blade 101 that may be extended and retracted from a blade sheath 104 under the influence of a pushe button 102 in a well recogniazed fashion.

Figure 3:
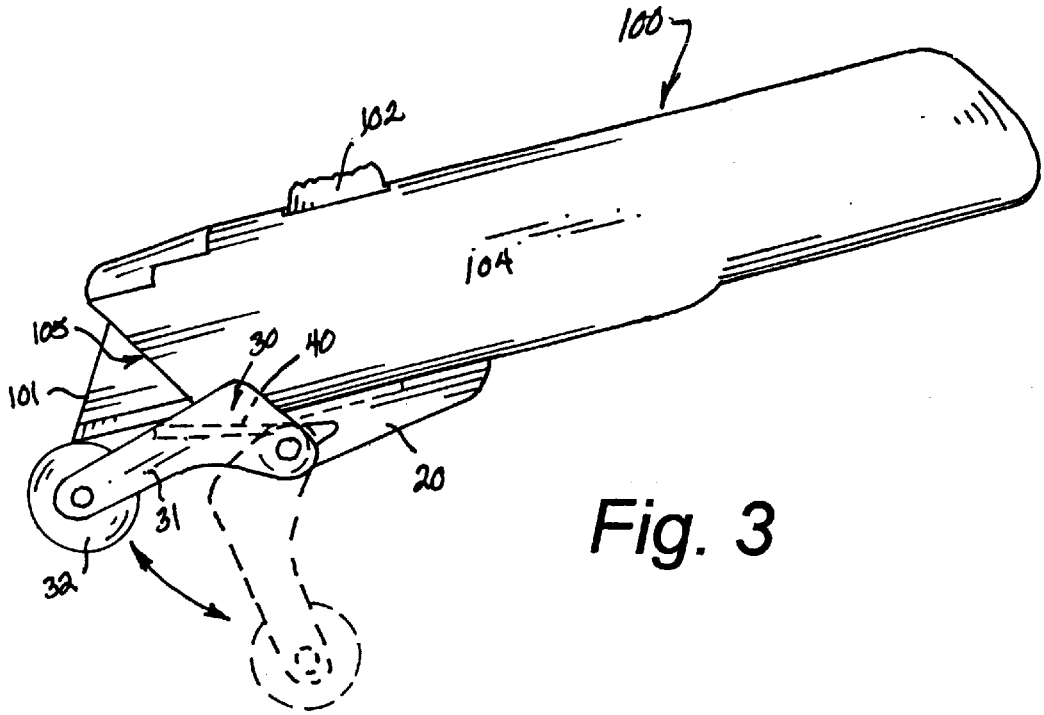
FIG. 3 is a perspective viewof the safety knif construction with the cutting blade paritally retracted; and, FIG. 4 is a front perspective view of the arrangemtn depicted in FIG. 3.

As shown in FIGS. 1 and 3, the utility knife 100 is imroved by the addition of a contoured generally wedge shaped mounting member 20 affixed to the undrside of hte blade sheath 104 proximate the mouth 105 of hte blade sheath 104 wherein, the mounting member 20 has a rearwardly tapered configuration for reasons that will be expalined in greater detail furhter on in the specification.

Figure 4:
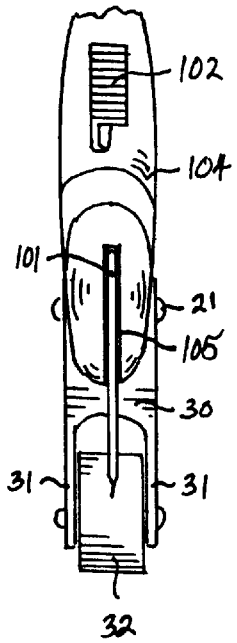

In addition the forward end of the contoured mounting member 20 is pivoatily connected as at 21 to a wheeled arm member 30 having bifurcated arms 31 that rotatably support a wheel element 32 as depicted in FIG. 4.

Furhtermore, as can best be appreciated by reference to FIG. 3, the wheeled arm member 30 is normally biased away from the tapered end of hte monting member 20 and into a closed blade covering position by a spring biasing element 40.

As was furhter previously described earlier on in the specificatio and depicted in FIGS. 2A through 2D, the force of the spring biasing element 40 can be easily overcome by the user prior to initiating a cut into the top surface 201 of a box or carton 200 wherein, the overcoming force will pivot the wheeled arm member 30 into contact with the tapered end of the mounting member 20.

This action limits the penetrating depth of hte cutting blade 101 of the utility knife 100 while te wheel elemtn 32 facilitates the rearward movement of the utility knife 100 during the cutting stroke.

Then at the effective end of hte cutting stroke, the force on the spring element 40 will be removed to restore the wheeled arm member 30 into its protective covering relationship with the cutting blade 101.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An improvement to a conventional utility knife having a cutting blade retractably dispoed within a blade sheath under the influence of a push button wherein, the improvement comprises a contoured mounting member affixed to the bottom of the blade sheath proximate the blade opening a wheeled mounting arm having an inboard end pivotally associated with the mounting member and having an outboard end provided with a wheel element; and, means for biasing the wheeled arm member into a normally closed covering relationship with the cutting blade of the utility knife.

2. The improvement as in claim 1; wherein, said mounting member hs a rearwardly tapered generally wedge shaped configuration.

3. The improvement as in claim 1; wherein, the wheeled arm member is provided with bifurcated arms adapted to rotatably support said wheel element.

4. The improvement as in claim 2; wherein, the wheeled arm member is provided with bifurcated arms adapted to rotatably support said wheel element.

* * * * *

UNITED STATES PATENT AND TRADEMARK OFFICE

CERTIFICATE OF CORRECTION

PATENT NO. : 6,748,659 B1
APPLICATION NO. : 10/300858
DATED : June 15, 2004
INVENTOR(S) : Raymond L. Street It is certified that error appears in the above-identified patent and that said Letters Patent is hereby corrected as shown below:

In Column 1, line 22, please delete “wheelded” and insert therefor --wheeled--
In column 1, line 27, please delete “guard” and insert therefor --guard--
In column 1, line 43, please delete “bboth” and insert therefor --both--
In column 1, line 46, please delete “hte vutting” and insert therefor --the cutting--
In column 1, line 53, please delete “invnetion” and insert therefor --invention--
In column 1, line 54, please delete “ounting” and insert therefor --mounting--
In column 1, line 57, please delete “spsring” and insert therefor --spring--
In column 1, line 63, please delete “foreced” and insert therefor --forced--
In column 1, line 63, please delete “agaisnt” and insert therefor --against--
In column 1, line 67, please delete “hte” and insert therefor --the--
In column 2, line 1, please delete “hte” and insert therefor --the--
In column 2, line 2, please delete “elemtn” and insert therefor --element--
In column 2, line 13, please delete “hte” and insert therefor --the--
In column 2, line 17, please delete “tot he” and insert therefor --to the--
In column 2, line 19, please delete “viewof” and insert therefor --view of--
In column 2, line 19, please delete “knif” and insert therefor --knife--
In column 2, line 20, please delete “paritally” and insert therefor --partially--
In column 2, line 21, please delete “arrangemtn” and insert therefor --arrangement--
In column 2, line 32, please delete “pushe” and insert therefor --push--
In column 2, line 32, please delete “recogniazed” and insert therefor --recognized--
In column 2, line 35, please delete “imroved” and insert therefor --improved--
In column 2, line 36, please delete “undrside of hte” and insert therefor --underside of the--
In column 2, line 37, please delete “hte” and insert therefor --the--
In column 2, line 40, please delete “furhter” and insert therefor --further--
In column 2, line 42, please delete “pivoatily” and insert therefor --pivotally--
In column 2, line 45, please delete “Furhtermore” and insert therefor --Furthermore--
In column 2, line 47, please delete “hte monting” and insert therefor --the mounting--
In column 2, line 50, please delete “furhter” and insert therefor --further--
In column 2, line 51, please delete “specificatio” and insert therefor --specification--
In column 2, line 59, please delete “te” and insert therefor --the--
In column 2, line 59, please delete “elemtn” and insert therefor --element--
In column 2, line 62, please delete “hte” and insert therefor --the--
In column 3, line 15, please delete “dispoed” and insert therefor--disposed--

UNITED STATES PATENT AND TRADEMARK OFFICE

CERTIFICATE OF CORRECTION

PATENT NO. : 6,748,659 B1
APPLICATION NO. : 10/300858
DATED : June 15, 2004
INVENTOR(S) : Raymond L. Street It is certified that error appears in the above-identified patent and that said Letters Patent is hereby corrected as shown below:

In column 4, line 9, please delete "hs" and insert therefor --has--

Signed and Sealed this

Fourth Day of September, 2007

JON W. DUDAS
*Director of the United States Patent and Trademark Office*